United States Patent [19]

Shockley

[11] Patent Number: 4,987,815

[45] Date of Patent: Jan. 29, 1991

[54] ACOUSTIC AND ELECTRIC COMBINATION GUITAR

[75] Inventor: Gary Shockley, 9 Dartmouth Dr., Atco, N.J. 08004

[73] Assignee: Gary Shockley, Atco, N.J.

[21] Appl. No.: 223,953

[22] Filed: Jul. 25, 1988

[51] Int. Cl.[5] ..... G10D 1/08; G10H 1/32

[52] U.S. Cl. ..... 84/291; 84/263; 84/267; 84/290

[58] Field of Search ..... 84/1.14–1.16, 84/1.04, 1.06, 263, 291, 267, 723, 726, 731, 743

[56] References Cited

U.S. PATENT DOCUMENTS

| | | | |
|---|---|---|---|
| D. 224,841 | 9/1972 | Dawson | D56/1 |
| 832,157 | 10/1906 | Platts . | |
| 1,828,315 | 10/1931 | Cavicchioli | 84/267 |
| 2,222,959 | 11/1940 | Stathopoulo | 84/267 |
| 3,196,729 | 7/1965 | Burns et al. | 84/171 |
| 3,680,423 | 8/1972 | Lander | 84/170 |
| 3,825,666 | 7/1974 | Jaggers | 84/1.16 X |
| 4,240,319 | 12/1980 | Soupios | 84/263 |
| 4,261,240 | 4/1981 | Aaroe | 84/1.16 X |
| 4,343,217 | 8/1982 | Brody | 84/1.16 |
| 4,483,233 | 11/1984 | Benson | 84/263 |
| 4,519,287 | 5/1985 | Naruse | 84/1.16 |
| 4,748,886 | 6/1988 | De Byl | 84/1.16 X |
| 4,785,705 | 11/1988 | Patterson | 84/1.16 |

FOREIGN PATENT DOCUMENTS

| | | |
|---|---|---|
| R147092 | 1/1956 | Fed. Rep. of Germany . |
| 2557721 | 2/1984 | France . |
| 2137007 | 9/1984 | United Kingdom . |

*Primary Examiner*—A. T. Grimley
*Assistant Examiner*—Matthew S. Smith

[57] ABSTRACT

A combination guitar having a full acoustical hollow body with the standard neck, head and strings supported between tuners on the head to a bridge on the top panel of the guitar's acoustical body with a solid electric guitar body structurally attached to the side wall of the acoustical hollow body with a second neck, head and strings supported over electronic pick up devices to transmit to the amplifier with volume and balance control mechanisms for the electric portion of the guitar to balance with an acoustical pick up inside the hollow body for transmission to the amplifier.

7 Claims, 2 Drawing Sheets

ACOUSTIC AND ELECTRIC COMBINATION GUITAR

BACKGROUND OF THE INVENTION

This invention relates to a single device having the capabilities of both an acoustical and electric guitar.

Many musical compositions are written to include sections played on both an acoustical and on an electric guitar. In some instances, the parts switch back and forth between the two instruments. This poses no great problem when the musical composition is being played in a studio. The parts can be played independently, even separated by days, and then dubbed together simulating a continuous flow of music from one guitar to the other guitar. The problem arises when the musical composition having been recorded is now popular and the performer wishes to include that musical composition in a combination presentation. The common practice is to play the piece either on the acoustical guitar or on the electric guitar and not attempt to switch between instruments. This makes for a generally unsatisfactory combination performance as the musical composition is played and sounds much different from the recording and from the way the composer intended.

The prior art includes combination electric guitars and a number of combination instruments but those devices do not satisfy the need described above and do not attain the objects described herein below.

SUMMARY OF THE INVENTION

It is an object of the present invention to produce a single musical instrument that can be played either as an acoustical guitar or as an electric guitar allowing the artist to switch back and forth with no interruptions.

It is a further of the present invention to provide a combination acoustical and electrical combination guitar that does not interfere with the acoustics of the acoustical body of the acoustical guitar.

It is a further object of the present invention to provide a single musical instrument that allows the interconnection of the electrical components to allow adjustment and balancing of the acoustical portion of the instrument with the amplifier and then adjust the electric portion of the instrument to the acoustical output through the amplifier.

The invention is an acoustical and electrical combination guitar including a hollow body for an acoustical guitar having a top panel with an aperture opening through the top panel to the interior of the hollow body and a continuous side wall. The combination guitar also includes a first neck attached at one end to the hollow body, a first head attached to a terminal end of the first neck, and a set of guitar strings strung and supported between tuners on the head over the aperture to a bridge attached to the top panel. The combination guitar further includes an acoustical pickup means attached to the hollow body, preferably attached inside the hollow body to pick up sounds for transmission to an amplifier means to amplify the sounds. The combination guitar further includes an electric guitar solid body attached to the side wall of the acoustical body, the solid body having a top surface facing the same direction as the top panel. The combination guitar also includes a second neck attached to the solid body, a second head attached to a terminal end of the second neck, and a second set of strings strung and supported between second tuners on the second head and a second bridge attached to the top surface, over electronic pickup means to pick up sounds from the strings to transmit them to the amplifier means. The combination guitar also includes volume and treble/bass control means, preferably attached to the acoustical body, to control and balance the treble and bass output from the electric guitar. Finally, the combination guitar includes wire connection means to connect the various electric means to two jack connection means, one for the electric guitar output to the amplifier means and one for the acoustical guitar output, both to the amplifier means. It is preferred that the upper surface of the top panel of the acoustical hollow body and the top surface of the electric guitar form a continuous flat plane. It is further preferred that the jack connection means open from the hollow body. It is further preferred that the volume and balance control means comprise control knobs positioned on the upper surface of the top panel of the acoustical body. It is further preferred that the acoustic set of strings number twelve and the electric set of strings number six. It is further preferred that the necks face in parallel directions both normal to the top surface of the acoustical body. It is further preferred that the necks angle toward each other in the same plane.

BRIEF DESCRIPTION OF THE DRAWINGS

FIG. 6 is a schematic electrical diagram of a circuit of the acoustical and electric combination guitar illustrated in FIG. 1.

DESCRIPTION OF PREFERRED EMBODIMENTS

Figure 1:
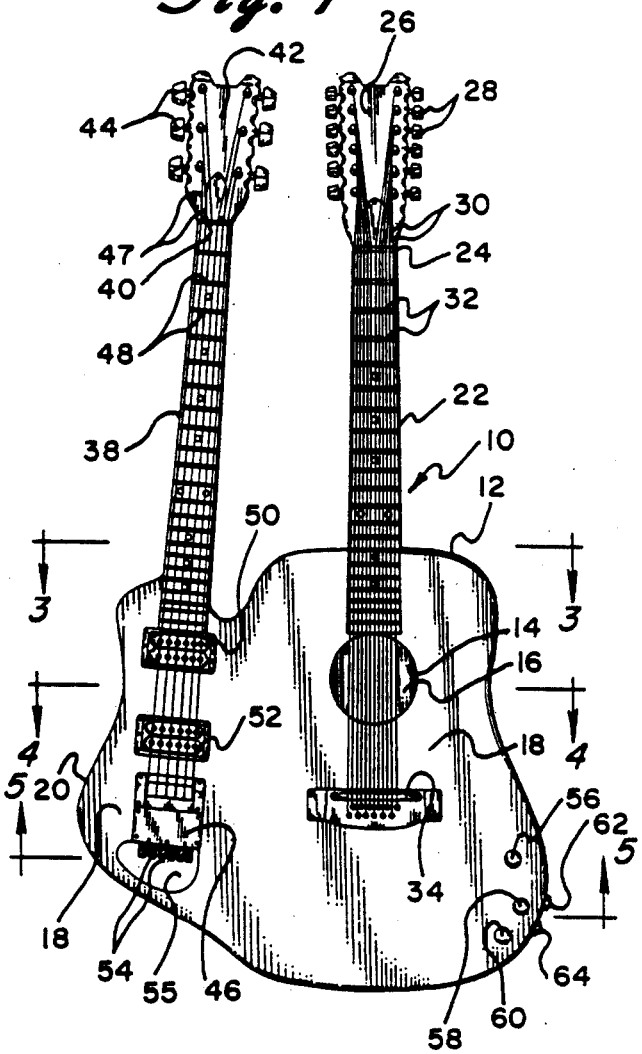
FIG. 1 is a front view of an acoustical and electric combination guitar of the present invention.
Figure 2:
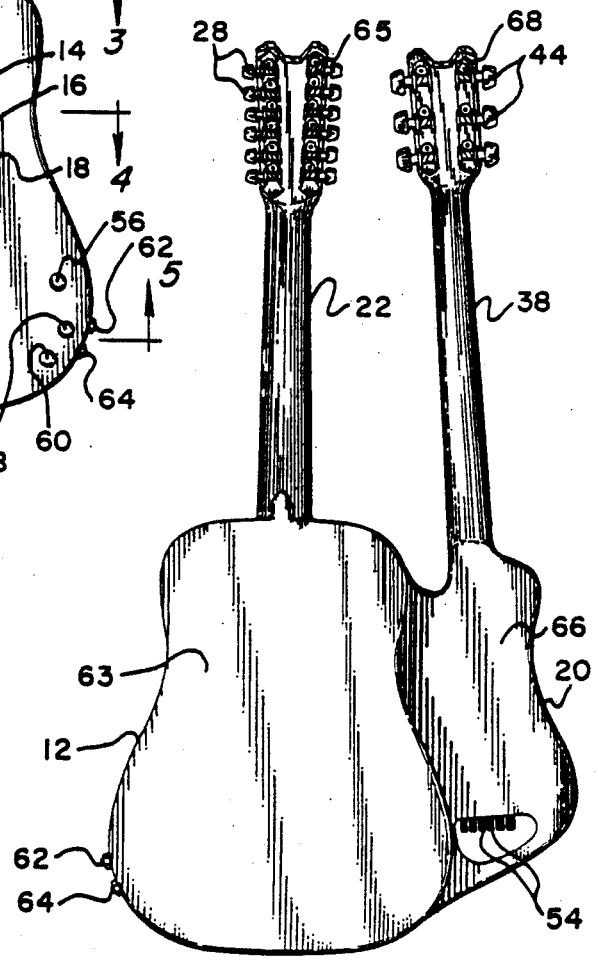
FIG. 2 is a rear view of the combination guitar illustrated in FIG. 1.

In FIG. 1, acoustical and electric combination guitar 10 is illustrated having acoustical hollow body 12 which includes top panel 14 through which aperture 16 is cut into the interior of the hollow body. Top surface 18 is a continuous flat surface not only of top panel 14 but also of solid body 20 of the electric portion of combination guitar 10. Neck 22 is attached and extends from body 12 terminating at nut 24 at which position head 26 attaches and extends further in the same direction. Twelve knobs and tuner mechanisms 28 are rotatably connected into head 26 and twelve strings 30 connected to tuner mechanisms 28 are strung and supported by nut 24 and bridge and acoustic pick up 34 over frets 32 and hole 16. The mechanism just described is a standard neck and string mechanism for twelve string acoustical guitars. Top surface 18 extends across the entire top panel 14 and over solid body 20 which supports neck 38 extending in the same general direction as neck 22, except that it is angled slightly toward neck 22 in the same plane. Neck 22 and neck 38 face in generally parallel directions angled slightly toward each other and normal to face 18. At the terminal end of neck 38 is nut 40 to which head 42 is attached. Six tuner knobs and mechanisms are attached and are part of head 42. Strings 47 are attached to the tuner mechanisms and are supported by nut 40 and bridge 46 over frets 48, treble electrical pick up 52, and base electrical pick up 50. As with some electrical guitars, fine tuner knobs 54 allow mechanical fine tuning of strings 47. For control of the electric portion of combination guitar 10 base volume control knob 56 and treble volume control knob 58 allow control of the volume of those two sections of the pick up. Balance control knob 60 allows balancing the base and treble to achieve a satisfactory sound. Female jack 62 provides connection of the acoustical microphone to the amplifier and female jack 64 provides connection of the electrical guitar portion output to the amplifier. As illustrated in FIG. 2, bottom panel 62 of acoustical body 12 is a good deal deeper then bottom surface 64 of solid body 20. While the volume and thus the depth of hollow body 12 is important to achieve the proper acoustical sound, the thickness of solid body 20 is merely for structural and/or appearance purposes. In this view, rack and pinion gears 64 attached to tuner knobs 28 allow adjustment of the tightness of strings 30. Likewise, rack and pinion gears 68 attached to knobs 46 allow the six strings of the electric guitar portion to be tightened or loosened to tune that set of strings.

Figure 3:
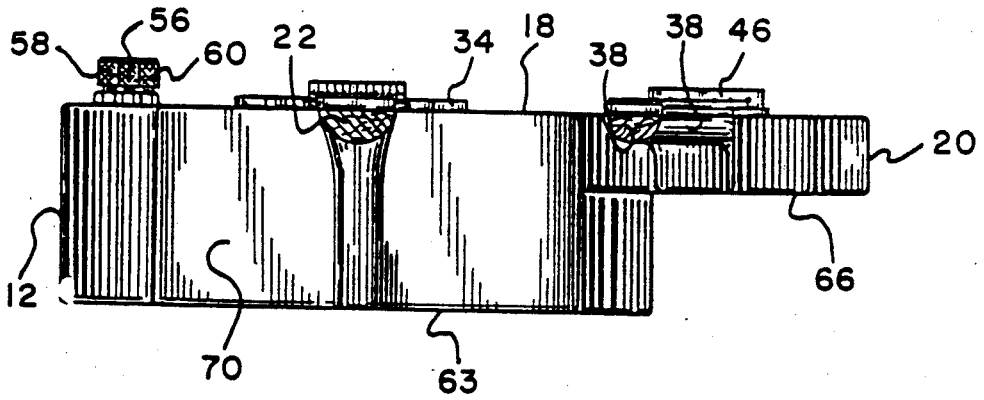
FIG. 3 is a cross-sectional view taken along lines 3—3 of FIG. 1.
Figure 4:
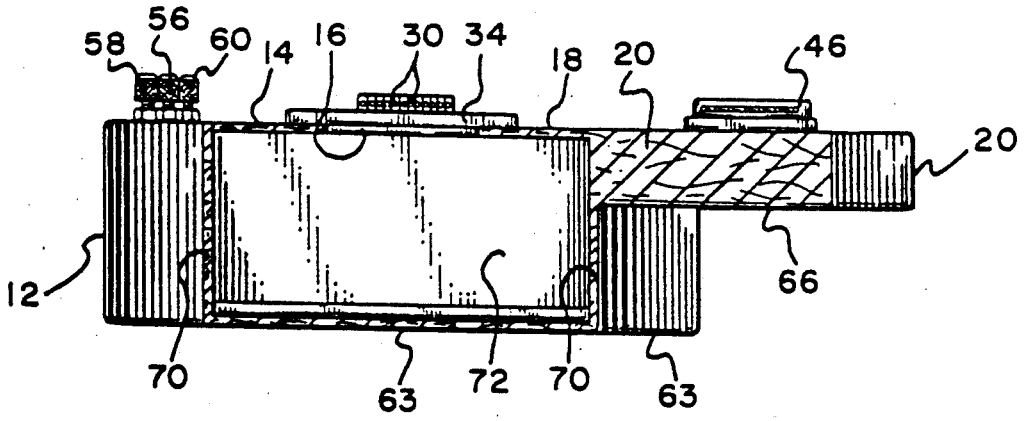
FIG. 4 is a cross-sectional view taken along lines 4—4 of FIG. 1.
Figure 5:
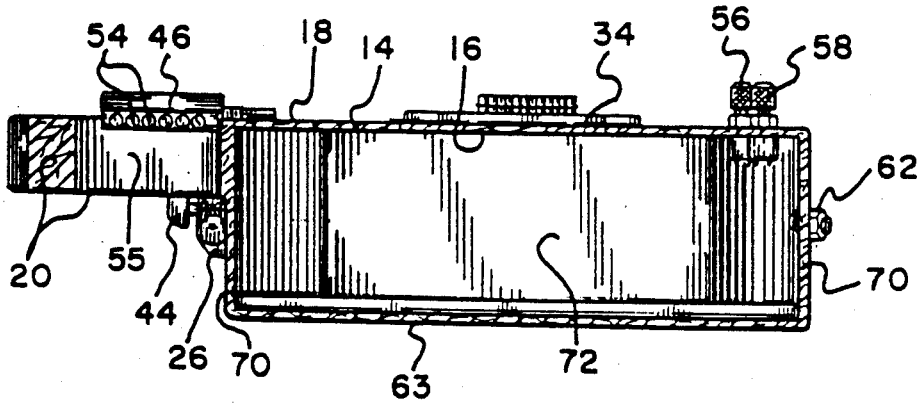
FIG. 5 is a cross-sectional view taken along lines 5—5 of FIG. 1.

In FIG. 3, continuous side wall 70 is a curved upright wall extending around the entire hollow body 12 enclosing the entire space of the acoustical hollow body. The difference in the depth from top surface 18 of bottom 63 and bottom surface 66 is illustrated in this view. In FIG. 4, interior space 72 of acoustical hollow body 12 is shown bounded by top panel 14, bottom panel 63 and side wall 70. This view also illustrates the melding of solid body 20 directly into side wall 70. This drawing shows a single piece of wood but it should be understood that multiple pieces of wood may be used being glued together under pressure. This view also illustrates aperture 16 opening interior space 72 to strings 30. FIG. 5 shows interior space 72 looking in the opposite direction and illustrating the end of bridge 46 with fine tuner knobs 54. Opening 55, allows easy access to fine tuner knobs 54 and extends entirely through solid body 20.

FIG. 6 is a schematic diagram of a typical standard circuit that may be utilized in the combination guitar of the present invention. The microphone sound pick up 74 is located in the acoustical hollow body, but a sound pick up may be located proximate bridge 34. The output is adjusted in amplifier 76 for output to loud speaker 78. After that has been adjusted, the adjustments of the electric portion of combination guitar 10 from strings 47 is adjusted by knobs 56, 68 and 60 to provide a suitable compliment to the acoustical guitar output.

While this invention has been described with reference to the specific embodiments disclosed herein, it is not confined to the details set forth and the patent is intended to include modifications and changes which may come within and extend from the following claims.

I claim:

1. An acoustic and electric combination guitar comprising;

(a) a single, integral body with both hollow and solid characteristics, (b) said body having an acoustic guitar hollow portion and an electric guitar solid portion, (c) a first neck having one end attached to the hollow portion and a free terminal end, (d) a first head attached to the terminal end of the first neck, (e) a first set of strings strung over an aperture and supported between a first set of tuners located on the first head and a bridge attached to the top panel of the acoustic guitar hollow portion, (f) the electric guitar solid portion of the body having a top surface facing in the same direction as the top panel, and (g) a second neck attached to and extending from the solid portion of the body in substantially the same direction as the first neck wherein said second neck has one end attached to the solid portion of the body and a free terminal end, (h) a second head attached to said terminal end of the second neck, (i) a second set of strings strung over electric pickups and supported between a second set of turners located on the second head and a second bridge attached to the top surface, wherein the electric pickups pick up sound signals from the second set of strings and transmit the sound signals to an amplifier.

2. The combination guitar of claim 1 wherein the upper surface of the top panel of the acoustic hollow portion of the body and the top surface of the electric guitar solid portion of the body form a continuous flat plane.

3. The combination guitar of claim 1 further comprising jack connections which open from the hollow portion of the body.

4. The combination guitar of claim 1, wherein the necks are substantially parallel to each other and normal to and coplaner with the upper surface of the top panel of said acoustic guitar hollow portion.

5. An acoustic and electric combination guitar comprising:

(a) a single, integral body with both hollow and solid characteristics, (b) said body having an acoustic guitar hollow portion and an electric guitar solid portion, (c) a first neck having one end attached to the hollow portion and a free terminal end, (d) a first head attached to the terminal end of the first neck, (e) a first set of strings strung over an apertureand supported between a first set of tuners located on the first head and a bridge attached to the top panel of the acoustic guitar hollow portion, (f) the electric guitar solid portion of the body having a top surface facing in the same direction as the top panel, (g) a second neck attached to and extending from the solid portion of the body in substantially the same direction as the first neck wherein said second neck has one end attached to the solid portion of the body and a free terminal end, (h) a second head attached to said terminal end of the second neck, and (i) a second set of strings strung over treble and bass electric pickups and supported between a second set of tuners located on the second head and a second bridge attached to the top surface, wherein the treble and bass electric pickups pick up sound signals from the second set of strings and transmit the sound signals to an amplifier.

6. The combination guitar of claim 5, wherein the upper surface of the top panel of the acoustic hollow portion of the body and the top surface of the electric guitar solid portion of the body form a continuous flat plane.

7. The combination guitar of claim 5, wherein the necks are substantially parallel to each other and normal to and coplaner with the upper surface of the top panel of the acoustic guitar hollow portion.

* * * * *